United States Patent [19]

Bianchi

[11] 4,221,541

[45] Sep. 9, 1980

[54] FAN COMPRISING A BLADE PITCH CONTROL MECHANISM

[75] Inventor: Emilio Bianchi, Varese, Italy

[73] Assignee: AXIAL International Aktiengesellschaft, Mauren, Liechtenstein

[21] Appl. No.: 880,383

[22] Filed: Feb. 23, 1978

[30] Foreign Application Priority Data

Feb. 28, 1977 [IT] Italy ..... 20752 A/77
Feb. 21, 1978 [IT] Italy ..... 20483 A/78

[51] Int. Cl.[3] ..... F04D 29/36
[52] U.S. Cl. ..... 416/157 R; 416/48
[58] Field of Search ..... 416/157 R, 157 B, 157 C, 416/207, 48, 153

[56] References Cited

U.S. PATENT DOCUMENTS

| | | | |
|---|---|---|---|
| 2,665,054 | 1/1954 | Fischer | 416/207 X |
| 2,826,395 | 3/1958 | Petty | 416/157 X |
| 3,300,123 | 1/1967 | Freyholdt et al. | 416/207 X |
| 3,768,546 | 10/1973 | Shipes | 416/157 B |
| 3,792,937 | 2/1974 | Chilman | 416/157 |
| 3,844,680 | 10/1974 | Säterdal | 416/157 |
| 3,984,194 | 10/1976 | Fermer | 416/207 X |
| 4,019,792 | 4/1977 | Monroe | 416/157 |
| 4,037,986 | 7/1977 | Chilman | 416/157 R |
| 4,046,486 | 9/1977 | Kolb | 416/157 R |
| 4,049,363 | 9/1977 | Baumann | 416/157 B |

FOREIGN PATENT DOCUMENTS

| | | | |
|---|---|---|---|
| 141466 | 6/1951 | Australia | 416/207 |
| 558156 | 6/1957 | Belgium | 416/157 R |
| 910430 | 6/1946 | France | 416/157 |
| 985885 | 3/1951 | France | 416/157 |
| 321395 | 10/1934 | Italy | 416/207 |
| 560626 | 4/1975 | Switzerland | 416/157 |
| 1028824 | 3/1966 | United Kingdom | 416/157 |
| 1372962 | 11/1974 | United Kingdom | 416/157 |

*Primary Examiner*—Everette A. Powell, Jr.
*Attorney, Agent, or Firm*—Kurt Kelman

[57] ABSTRACT

A mechanism for controlling the pitch of fan blades during rotation of the fan impeller includes a cylinder-piston unit mounted coaxially on the impeller hub, a first conduit arranged to deliver compressed air to one cylinder chamber for axially moving the piston in an operating direction, a normally closed valve in this conduit for preventing compressed air delivery to this chamber, a spring in the other cylinder chamber biasing the piston in an opposite direction, a second conduit arranged to deliver an environmentally controlled flow of compressed air to the valve for opening the valve under predetermined environmental conditions whereby the compressed air in the first conduit is delivered to the one cylinder chamber and moves the piston in the operating direction against the spring bias, and rods connecting rotatable fan blade supports to the piston and causing rotation of the supports about their axes on movement of the piston to control the pitch of the blades.

10 Claims, 6 Drawing Figures

Fig. 1
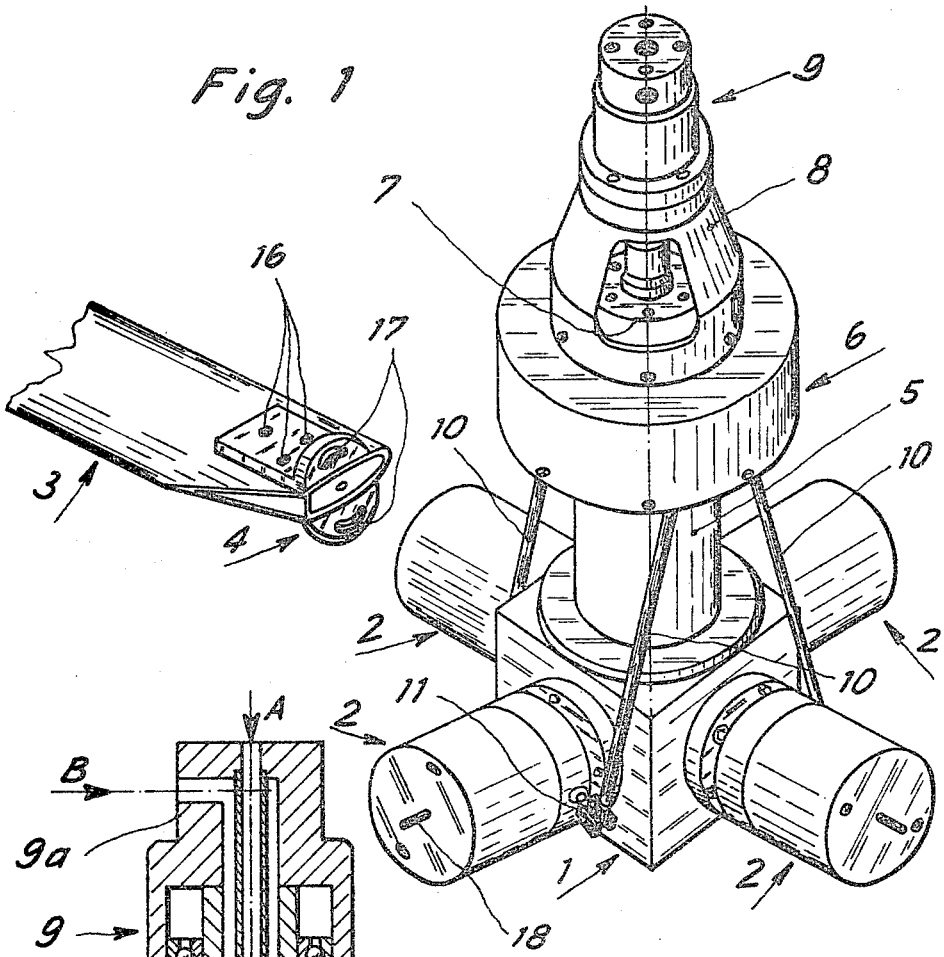
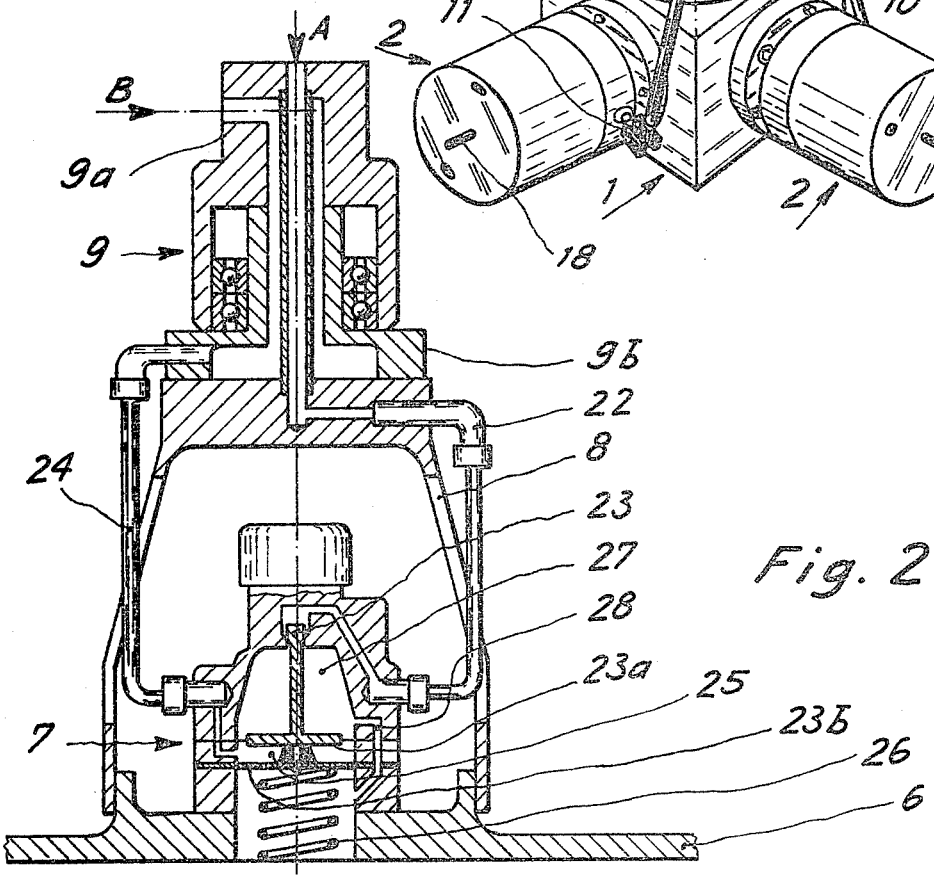
Fig. 2

FAN COMPRISING A BLADE PITCH CONTROL MECHANISM

Object of this invention is an industrial type fan, normally of a large diameter, even in the range of several meters, in which the variation of the blade pitch is effected while in operation and depending upon environmental conditions, such as temperature, humidity, pressure or other, measured by means of a known type of equipment. The fan consists essentially of two parts, one of which consists of a unit for controlling the movement of the blades, and the other is the actual fan impeller, solidly connected to the first and the blades of which are operated by the first part by means of hinged connecting rods.

According to the invention, the fan impeller consists of a truncated pyramidal hub with a polygonal base having a number of sides equal to the number of blades, the blades being inclined with respect to the axis of rotation at a pre-arranged angle to give the blades a certain inclination in the opposite direction to that of the flow of air, which inclination is called a "precone", the function of which is to reduce the stress on the blades during the operation of the fan.

Each fan blade is mounted on the sides of the hub by means of a connecting support including a shaft forming an integral part of a respective hub side, upon which rotates by means of bearings an external sleeve closed at the end. The blade is connected to the closed end of the sleeve by the interposition of two flanged half forks and provided with arched slots for the passage of bolts for connection on the revolving sleeve. Mounted on the sleeve in a perpendicular direction to its axis of rotation is a fork to which one end of the rod controlling the variation of the pitch of the blade is connected in such a way as to oscillate.

According to the invention, the unit controlling the movement of the pitch of the blades consists of a coaxial cylindrical support forming an integral part with the hub of the impeller, upon which support is installed the body of the cylinder, within which a compressed air operated piston slides axially, this piston being connected to the other end of the rod controlling the pitch of the blades. Between the piston and the hub is arranged a helicoidal spring suitable for holding the piston, in the absence of opposing stress from above, in the furthermost position from the hub.

Compressed air is used for the movement of the piston, which is delivered through a connecting rotating manifold and is distributed by means of a double-acting valve controlled by external controls provided by well known instruments, and these controls are connected through the rotating manifold to the valve.

The cylinder-piston unit furthermore includes a means of directing the piston in such a way as to allow it to move axially but not revolve, and allows adjustable stopping at the stroke end so as to vary the field of action of the piston and the maximum pitch setting position of the blades with the piston at the stroke end.

The half forks with flange and arched slots for connecting the blades to the supporting revolving sleeve permit adjustment at assembly of the angular position of each blade with respect to its own support, and also to establish the pitch setting of the blades in the initial resting position with the piston at the idle stroke end, that is to say, without air pressure acting upon it.

The shafts are connected to the rotating sleeve and to the piston by means of ball joints so as to eliminate the misalignment which is created during the rotation of the blades.

According to another embodiment, the rods controlling the variation of the pitch of the blades and the forks with connecting ball joints to the piston and to the sleeve are situated on the inside of a hollow hub body while the cylinder-piston unit is mounted axially directly on the hub itself.

In this embodiment, the rotary control is transmitted to the blade by means of a radial shaft which passes axially through the supporting sleeve of the blade, and has one end pointing towards the center of the hub body connected with the control rod by means of a lever and ball joint, while the other end is clamped to the rotating supporting sleeve of the blade. This embodiment permits the obtaining of a fan with small axial dimensions of equal performance with respect to that having the control rods for the variation of the pitch situated on the outside of the hub.

These and other characteristics will appear more clearly from the following detailed description of a fan blade pitch control mechanism which is variable while the fan is in operation according to the invention, illustrated in the attached drawing, in non-limitative form, in which:

FIG. 1 shows, in a simplified perspective view, the whole fan according to the invention, with four blades, of which only one is shown and detached;

FIG. 2 schematically shows, in axial section, a detail of the compressed air connection and control unit;

Figure 3:
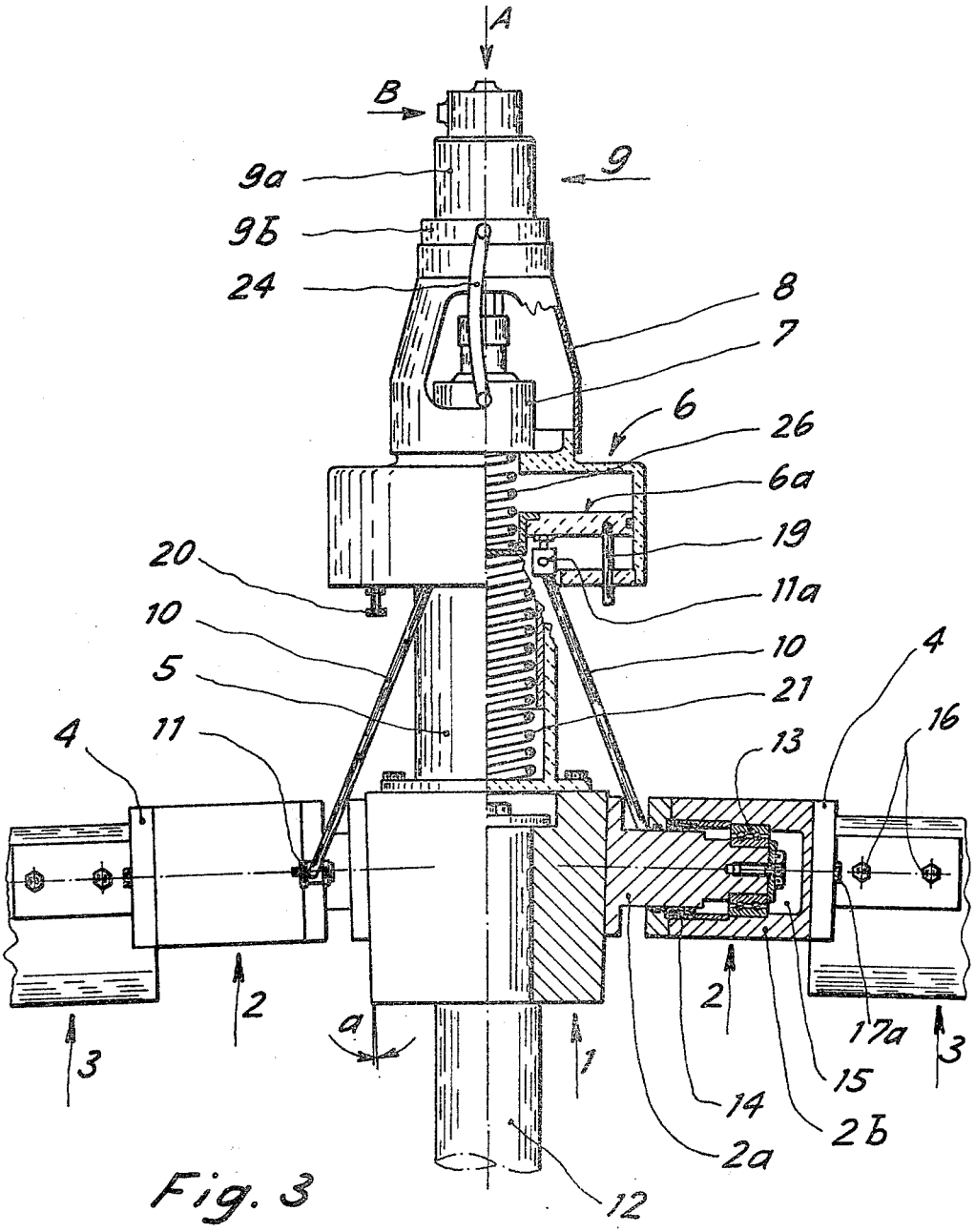
FIG. 3 shows the rotating unit and the blade control unit in half axial section.
Figure 4:
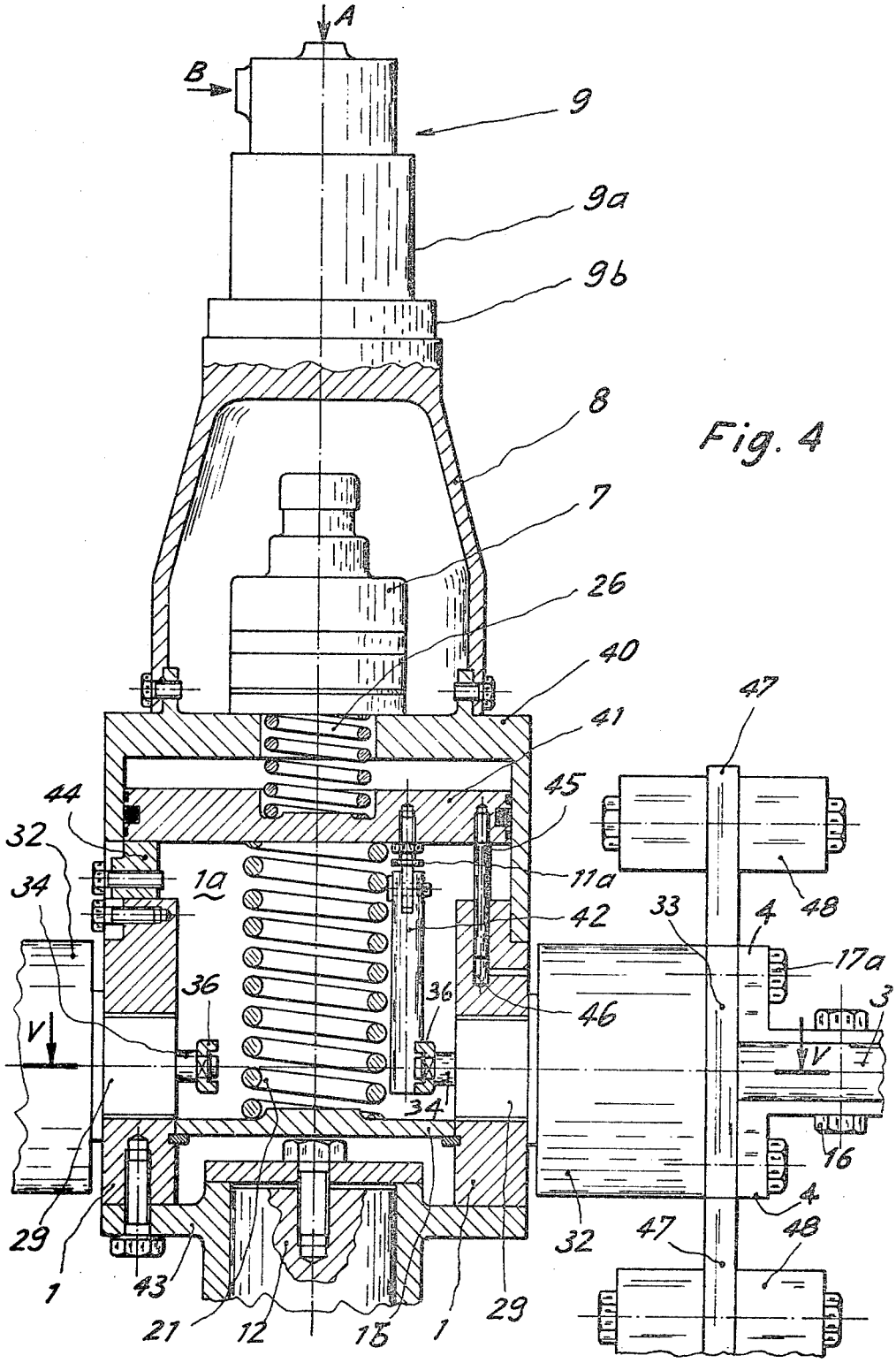
FIG. 4 shows in axial section, a modified embodiment of the blade control unit.

Referring in FIG. 1, the fan consists of a truncated-pyramidal hub 1, upon the surfaces of which are mounted the rotating supports 2 for the blades, at the ends of which are attached the blades 3 by means of flanged connections 4. Axially integral with hub 1 is the cylindrical support 5 which, in turn, is integrally connected to the cylinder-piston unit for pitch control. Coaxial mount 7 is integral with the cylindrical support, as is rotating manifold 9 mounted on support 8. Control of the variation of the pitch supplied by the cylinder-piston unit 6 is transmitted to the rotating supports 2 of the blades by means of the rods 10, through the forks 11 connected to the rods by ball-joints.

Referring to the more detailed showing of FIG. 3, hub 1 is connected in known manner to the motor shaft 12, with the lateral hub surfaces slightly inclined at an angle a with respect to the axis of rotation of the fan, equal to the angle of "precone" which has been established for the fan itself according to its characteristics. The rotating support 2 is mounted upon each lateral hub surface perpendicularly, and consists of a shaft **2*a* fixed to hub 1 and of a rotating sleeve 2*b*, with two ball bearings 13, 14 inserted between fixed shaft 2*a* and rotating sleeve 21. The outer end of the rotating sleeve 2*b* is closed so as to form a compartment 15** on the inside in which to collect the lubricating grease thrown outwards by the centrifugal force, and which, being unable to escape, is forced to remain on the inside for the lubrication of the rotating parts.

The blades 3 are attached to the end of the sleeve 2b by means of half forks 4 (see also FIG. 1) forming an integral part with the root of the blade by means of bolts 16 and having a flange with arched slots 17 through which the screws 17a pass and are tightened to the rotating sleeve 2b.

A coaxial dowel pin 18 (FIG. 1) is inserted between the sleeve and the blade to ensure the centering of the blade at the time of assembly.

As previously mentioned, forks 11 on the sleeves 2b are connected by rods 10 to the forks 11a integral with the piston 6a which slides in the cylinder 6. This piston (is held against rotation) with respect to the cylinder as it is guided by one or more pins 19 while the stroke end limit of the piston is fixed by adjustable stops 20.

A spring 21 is situated on the inside of the support 5 of the cylinder 6, one end of the spring pressing against hub 1 while the other spring end biases piston 6a into its stroke end position fasthest from hub 1 when the piston 6a is not operated by compressed air.

The distribution of the compressed air occurs substantially in the usual manner and is effected, with particular reference to FIG. 2, by rotating manifold 9 and mount 7. The operating compressed air arrives at the fixed part 9a of the manifold, as shown by the arrow A, if passes on to the rotating part 9b and then, by means of conduit 22, to the upper part of amount 7 where there is a valve 23. Compressed air also is delivered, as shown by the arrow B, to the same manifold under the control of a device for measuring the environmental conditions (temperature, pressure, etc.) and this compressed air passes through 9b and conduit 24 into a cavity 25 defined between a diaphragm 23a connected to the valve 23 and a diaphragm 23b connected to diaphragm 23a and which is upwardly biased by the upper end of a spacing spring 26, the lower end of which (is sealed in a central recess) in the piston 6a (FIG. 3). The cavity 27 below the valve 23 is connected by the passage 28 to the inside of the clinder 6.

Figure 5:
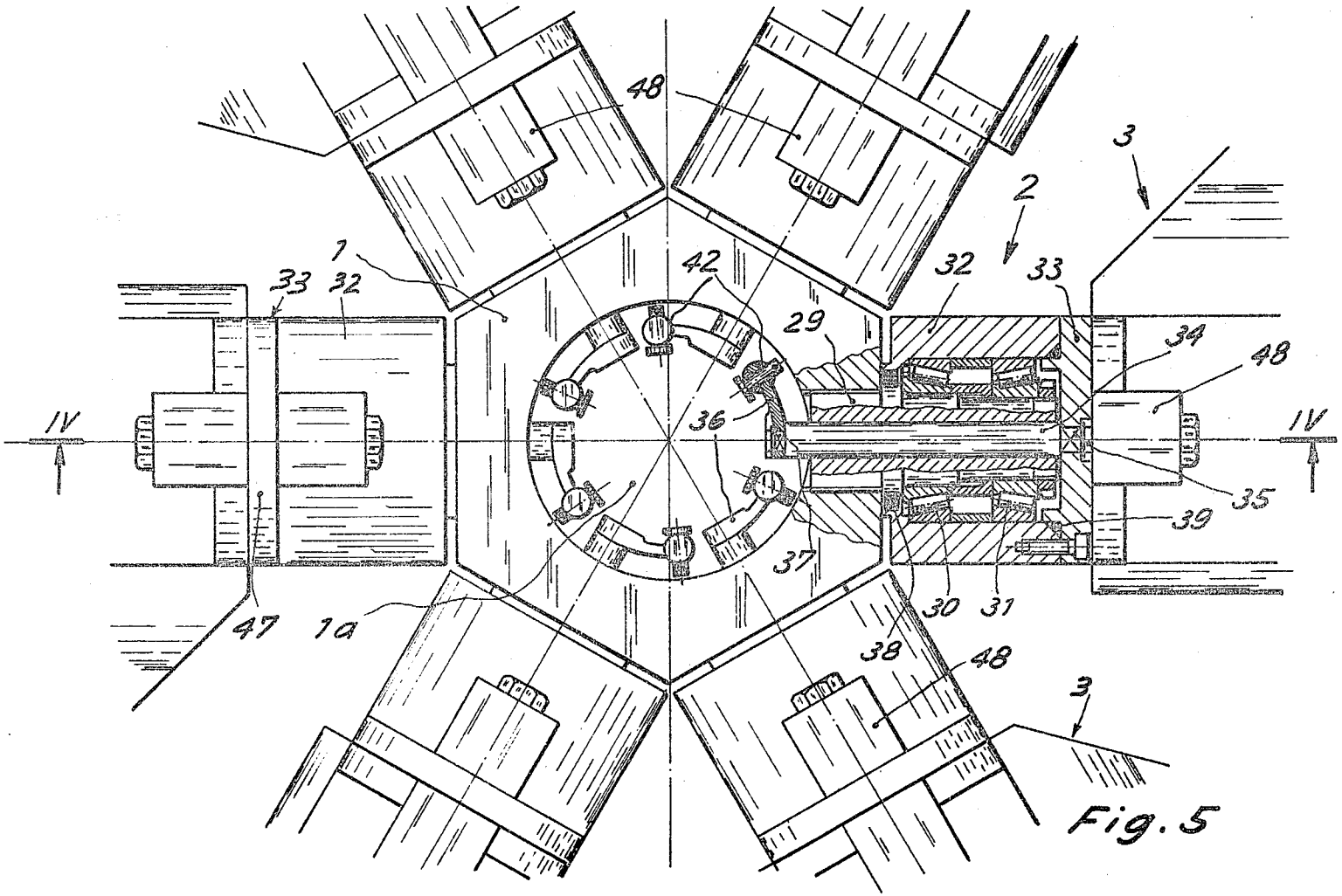
FIG. 5 shows in cross-section taken on the line V-V of FIG. 4, the blade control of FIG. 4 and the detail of the blade ratio.
Figure 6:
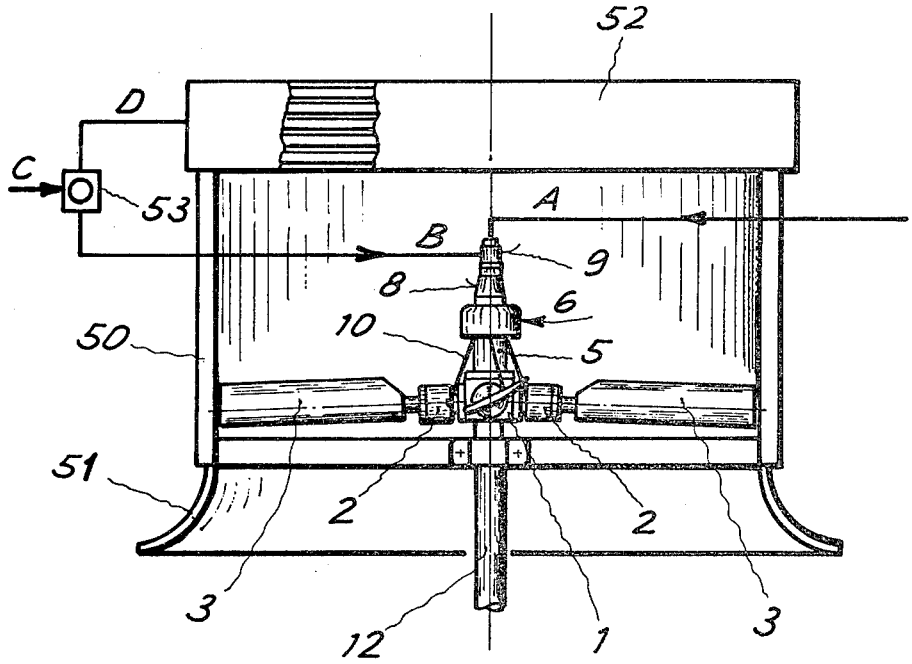
FIG. 6 illustrates a known ambient temperature measuring device useful for the control of this invention.

As shown in FIG. 6 and by way of example, the fan may be mounted in a manner similar to that shown in U.S. Pat. No. 3,768,546, the fan being inserted in cylindrical fan ring 50 with an inlet 51 in the lower part and tube bundle 52 in the upper part, a thermometer being inserted between the heat exchange tubes of the tube bundle to send a signal through line D to transducer 53. The transducer is connected to manifold 9 at the upper end of hub 1, the manifold being supplied by line A under pressure and the transducer being suppled by line C. To avoid redundancy in the description, the other reference numerals in this figure designate the same parts as in FIG. 1 to 5 show the compressed air supply control by an environmental condition measuring device.

The fan blade pitch control mechanism operates as follows:

At the moment of assembly, the blades 3 are coaxially positioned on pins 18 by means of adjustment permitted by the arched slots 17 on the rotating sleeve 2b, with an angle of pitch setting at an extreme position while cylinder 6 is idle and in which the spring 21 pushes the piston 6a to the upper stroke end position. During operation, the compressed air controlled by the environmental condition measuring device, as shown by arrow B, arrives through conduit 4 in cavity 25 and pushes the valve 23 upwards with the diaphragm 23a, which opens the passage for the compressed air arriving from A. The compressed air thus passes through conduit 22 into the chamber 27 and then through passage 28 into cylinder 6. This pushes piston 6a downwards against the bias of spring 21 while the bias of spacing spring 26 is reduced. In this way, the piston 6a pushes the rods 10 and they, by means of the forks 11, contemporaneously cause the rotating sleeves 2b and blades 3 attached to them to revolve to change the pitch of the blades.

After a certain movement, for a determined length of time, the spring 26 releasing itself, allows the reverse movement of the valve 23 until it is closed. At this point, the piston 6a stops and the blades 3 remain in the set position.

Upon change in the environmental conditions due to the functioning of the fan, the measuring device again intervenes to change the position of the valve 23 and, therefore, also that of the piston 6a.

According to another more compact embodiment, the control unit for the variation of the blade pitch is situated inside hub 1. In this case, there are six blades and hub 1 is accordingly of a hexagonal shape (FIG. 5) and is provided with a large internal cavity 1a. Hollow screw bolts 29 are inserted in hub 1 in a radial direction with respect to the axis of rotation, and are equal in number to the blades; these bolts may be inclined with respect to the axis of rotation of the fan in such a way as to give the blades a predetermined angle of precone.

A supporting sleeve 32 is mounted on each hollow bolt 29, rotating by means of two ball bearings 30 and 31. Substantially similar to the sleeve 2, sleeve 32 is closed by an end plate 33 upon which blade 3 is mounted by means of half forks 4 with arcuate slots 17 and bolts 17a, as shown in FIG. 1. Shaft 34 is journaled in each hollow bolt 29 in a rotating manner for controlling the pitch of the blades, the ends of the shaft being firmly connected to plate 33 of the rotating sleeve by means of polygonal connection 35 and to an arched lever 36 by means of another polygonal connection 37. The control shafts 34 extend to the inside of the cavity la of the hub and, therefore, all the arched levers 36 are arranged in a circle (FIG. 5).

Ring washers 38 and 39 are placed inside the rotating sleeve to prevent the expulsion of grease (caused by centrifugal force) necessary for lubricating the bearings. The cylinder 40 is fixed to the upper open end of hub 1 (FIG. 4) in which the piston 41 slides. This piston operates the rods 42 for control of the pitch, and these rods are internally arranged in the cavity of the hub, one end of which is hinged to the ends of the arched levers 36 and the other end is connected to the base of the piston by means of ball-joints 11a.

In this embodiment, counter-biasing spring 21 is arranged inside the hub between base plate 1b of the cavity and the bottom of the piston 41, while the spacing spring 26 remains housed in the body of the cylinder 40 and presses against the diaphragm in mount 7. The motor shaft 12 is connected to hub 1 by means of a flanged bushing 43. Piston stroke limiting abutments 44 are provided at the base of the piston 41 sliding in respective grooves in the cylinder 40 and may be fixed in desired positions for adjustment of the piston stroke according to the minimum and maximum setting desired.

The piston 41 can slide axially, operated by the compressed air coming from mount 7 for increasing the pitch, or by the spring 21 for return to the minimum pitch position, but must not revolve on its own axis, for which reason a pin 45, integral with the piston and parallel to its axis is provided and which slides in bore 46 of hub 1.

Lastly, an arm is fixed at the center of half forks 4, connected to the sleeve 32 supporting the blades, which protrudes from either end in a perpendicular direction to the blade surface, upon which arm are attached the masses 48, for balancing the blades so as to reduce the force of the spring 21, necessary to push the piston 41 into the upper part of the cylinder 40 when compressed air is not sent into it from mount 7.

What is claimed is:

1. In a fan comprising (a) an impeller including a hub arranged for rotation about an axis of rotation and having a polygonal base and a plurality of sides, (b) support shafts affixed to the sides of the hub for rotation therewith and extending at an angle with respect to the axis, (c) supports coaxial with the support shafts and rotatably mounted thereon, (d) fan blades mounted on the rotatable supports whereby rotation of the supports varies the pitch of the blades, and (e) a mechanism for controlling the pitch of the blades during rotation of the impeller: the pitch control mechanism including (1) a cylinder-piston unit mounted coaxially on the hub, the cylinder being axially stationary and the piston being axially movable in the cylinder and dividing the cylinder into two chambers, (2) a first axially stationary conduit means arranged to deliver compressed air to one of the cylinder chambers for moving the piston axially into an operating direction, (3) a normally closed valve in the first conduit means for preventing delivery of the compressed air to the one cylinder chamber, (4) a spring in the other cylinder chamber biasing the piston in a direction opposite to the operating direction, (5) a second axially stationary conduit means arranged to deliver an environmentally controlled flow of compressed air to the valve for opening the valve under predetermined environmental conditions whereby the compressed air in the first conduit means is deliverered to the one cylinder chamber and moves the piston in the operating direction against the bias of the spring, and (6) rod means connecting the rotatable fan blade supports to the piston and causing rotation of the supports on movement of the piston to control the pitch of the blades.

2. The fan of claim 1, further comprising a flanged connector adjustably mounting each blade coaxially on an associated one of the rotatable supports, the flange of the connector defining an arcuate slot concentric with the axis of the support and blade whereby the blades may be assembled with the associated supports at adjusted angles with respect to the supports.

3. The fan of claim 1, wherein the rod means comprises respective rods extending outside the hub and linked to the piston and the supports.

4. The fan of claim 1, further comprising a guide pin permitting the axial movement of the piston but preventing rotation thereof with respect to the cylinder, the spring in the other cylinder chamber having a bias moving the piston into an end position in the absence of compressed air in the one cylinder chamber, and a spacing spring in the one cylinder chamber between the piston and the valve.

5. The fan of claim 1, wherein the sides of the hub extend from the base at said angle and the support shafts extend perpendicularly to the sides.

6. The fan of claim 1, wherein the hub is a hollow body defining an axially extending cavity, the cavity housing the rod means, and the cylinder-piston unit is mounted directly on the hub, the hub cavity being in communication with the other cylinder chamber.

7. The fan of claim 6, wherein the support shafts define axial bores, the supports include radially extending shafts rotatably journaled in the axial bores of the support shafts and having inner ends extending into the hub cavity, and the rod means comprises respective arcuate rods extending concentrically about the axis of rotation in the cavity and linking the piston to the inner shaft ends.

8. The fan of claim 1, further comprising an arm mounted on each rotatably support and extending substantially perpendicularly to the blade mounted on the support, and opposing masses carried by the respective ends of the arm at respective sides of the blade for balancing the blade.

9. The fan of claim 1, further comprising a mount affixed to the cylinder and housing the valve, and a compressed air inlet manifold rotatably mounted on the cylinder, the first and second conduit means passing through the manifold and leading therefrom into the mount.

10. The fan of claim 1, further comprising adjustable stop means for delimiting the stroke of the piston.

* * * * *